US008509631B2

(12) United States Patent
Fukuda

(10) Patent No.: US 8,509,631 B2
(45) Date of Patent: Aug. 13, 2013

(54) IMAGE FORMING APPARATUS

(75) Inventor: Tadashi Fukuda, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 312 days.

(21) Appl. No.: 13/083,412

(22) Filed: Apr. 8, 2011

(65) Prior Publication Data

US 2011/0255883 A1 Oct. 20, 2011

(30) Foreign Application Priority Data

Apr. 16, 2010 (JP) ..... 2010-095273

(51) Int. Cl.
*G03G 15/08* (2006.01)
*G03G 15/00* (2006.01)

(52) U.S. Cl.
USPC ..... 399/24; 399/43

(58) Field of Classification Search
USPC ..... 399/24, 43, 258, 260, 262
See application file for complete search history.

(56) References Cited

U.S. PATENT DOCUMENTS

| | | | | |
|---|---|---|---|---|
| 7,269,382 | B2 * | 9/2007 | Hashimoto | 399/284 |
| 2002/0028094 | A1 * | 3/2002 | Sakemi et al. | 399/276 |
| 2002/0150401 | A1 * | 10/2002 | Matsuguma | 399/26 |
| 2005/0047832 | A1 * | 3/2005 | Hashimoto | 399/284 |
| 2005/0069335 | A1 * | 3/2005 | Ito et al. | 399/50 |
| 2006/0067718 | A1 * | 3/2006 | Toda et al. | 399/27 |
| 2010/0247120 | A1 * | 9/2010 | Murata et al. | 399/43 |

FOREIGN PATENT DOCUMENTS

| | | | |
|---|---|---|---|
| JP | 9-190142 | A | 7/1997 |
| JP | 2003-114571 | A | 4/2003 |
| JP | 2003-263079 | A | 9/2003 |
| JP | 2007-226037 | A | 9/2007 |

* cited by examiner

*Primary Examiner* — G. M. Hyder
(74) *Attorney, Agent, or Firm* — Canon USA, Inc., IP Division

(57) ABSTRACT

An image forming apparatus includes a developing device including a developer bearing member for bearing and conveying a developer and configured to develop a latent image formed on an image bearing member using the developer, a bias application unit configured to apply at least an AC bias to the developer bearing member, an integration unit configured to integrate an application time of the AC bias applied by the bias application unit, and a determination unit configured to determine a replacement timing of the developing device based on an integrated value by the integration unit.

6 Claims, 10 Drawing Sheets

IMAGE FORMING APPARATUS

BACKGROUND OF THE INVENTION

1. Field of the Invention

The present invention relates to an image forming apparatus including a developing device, including a developer bearing member for bearing a developer on its surface and conveying the developer, using an electrophotographic method for developing a latent image formed on an image bearing member.

2. Description of the Related Art

Conventionally, a developing device for bearing a developer on a surface of a developer bearing member, conveying and supplying the developer to the vicinity of a surface of an image bearing member having an electrostatic latent image borne thereon, and developing and visualizing the electrostatic latent image while applying an alternating (alternating current) electric field between the image bearing member and the developer bearing member has been well known.

The developing device reaches its lifetime end due to deterioration of the developer or deterioration of the developer bearing member by repeatedly performing image formation. When the developer deteriorates, defects such as fogging on a blank portion and toner scattering occur. The developer bearing member is driven to rotate as the image formation is performed, so that defects such as thin image density, image unevenness, and fogging on the blank portion occur due to surface abrasion or the like.

Japanese Patent Application Laid-Open No. 9-190142 discusses a technique for integrating a driving time of a developer bearing member and determining a lifetime end of a developing device based on an integrated value of the driving time.

Surface abrasion occurs due to physical pressure at the time of driving. Therefore, a certain degree of prediction can be made by integrating the driving time, as discussed in Japanese Patent Application Laid-Open No. 9-190142. However, deterioration of performance occurring when the developer bearing member reaches its lifetime end includes deterioration by surface abrasion and deterioration by surface adhesion of the developer. The developing device may reach its lifetime end by the developer adhering to the surface of the developer bearing member prior to the surface abrasion. In such a case, the lifetime end cannot be correctly detected, resulting in image defects.

SUMMARY OF THE INVENTION

The present invention is directed to an image forming apparatus that can be determined to reach its lifetime end even when it reaches its lifetime end by a developer adhering to a surface of a developer bearing member prior to surface abrasion.

According to an aspect of the present invention, an image forming apparatus includes a developing device including a developer bearing member for bearing and conveying a developer and configured to develop a latent image formed on an image bearing member using the developer, a bias application unit configured to apply at least an AC bias to the developer bearing member, an integration unit configured to integrate an application time of the AC bias applied by the bias application unit, and a determination unit configured to determine a replacement timing of the developing device based on an integrated value by the integration unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 2:
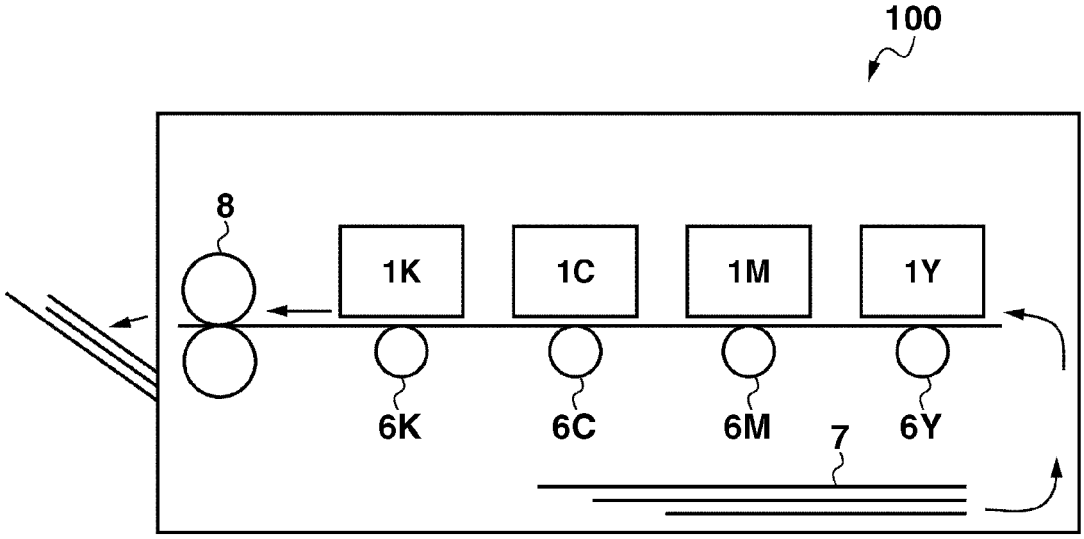
FIG. 2 is a schematic sectional view of an image forming apparatus according to each of the first to fifth exemplary embodiments of the present invention.

FIG. 2 is a schematic sectional view of an image forming apparatus according to a first exemplary embodiment of the present invention. The image forming apparatus includes a plurality of image forming units 1 (1K, 1C, 1M, and 1Y). The image forming units 1 in yellow (Y), magenta (M), cyan (C), and black (K) are arranged side by side.

Figure 1:
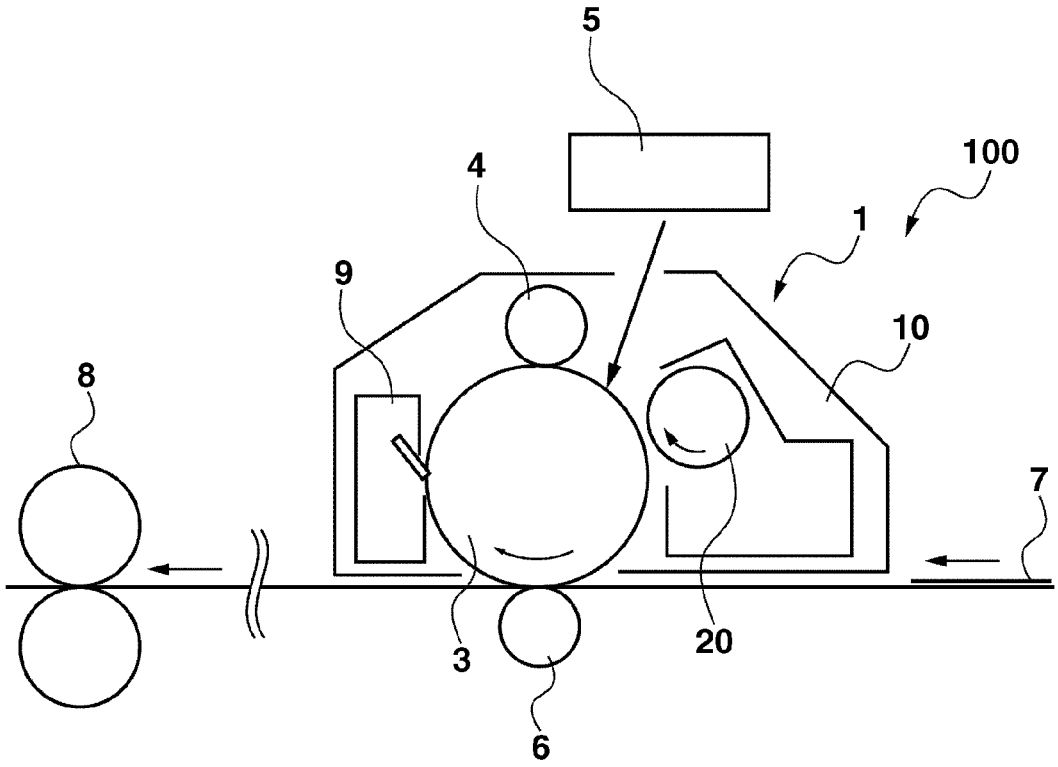
FIG. 1 is a schematic sectional view of an image forming unit according to each of first to fifth exemplary embodiments of the present invention.

In the present exemplary embodiment, the image forming units 1 in yellow (Y), magenta (M), cyan (C), and black (K) have similar configurations unless otherwise noted. Therefore, one of the image forming units 1 will be described below as a representative. Subscripts K, M, C, and Y of the image forming units 1K, 1C, 1M, and 1Y respectively represent colors of developers used for image formation but are omitted when described. The image forming unit 1 will be described below. FIG. 1 is a schematic sectional view illustrating the image forming unit 1. An electrophotographic image forming apparatus 100 including the image forming unit 1 illustrated in FIG. 1 has a photosensitive drum 3 serving as an image bearing member rotatably provided therein. First, a primary charger serving as a charging unit 4 uniformly charges the photosensitive drum 3. An exposure unit 5 exposes the photosensitive drum 3 to an information signal, to form an electrostatic latent image on the photosensitive drum 3, for example.

A developing device 10 develops and visualizes the electrostatic latent image formed on the photosensitive drum 3 using the developer. A transfer charger serving as a transfer unit 6 then transfers a visible image (toner image) onto a recording medium 7 such as a sheet. Further, a fixing device 8 serving as a fixing unit fixes the visible image, to obtain a permanent image. A cleaning device serving as a cleaning unit 9 removes residual transfer toners on the photosensitive drum 3. The image forming apparatus may be a cleaner-less image forming apparatus including no cleaning device 9. The image forming unit 1 may include the photosensitive drum 3, a primary charger 4 exerted on the photosensitive drum 3, a developing device 10, a cleaning device 9, and an exposure unit 5, as illustrated in FIG. 1.

Figure 3:
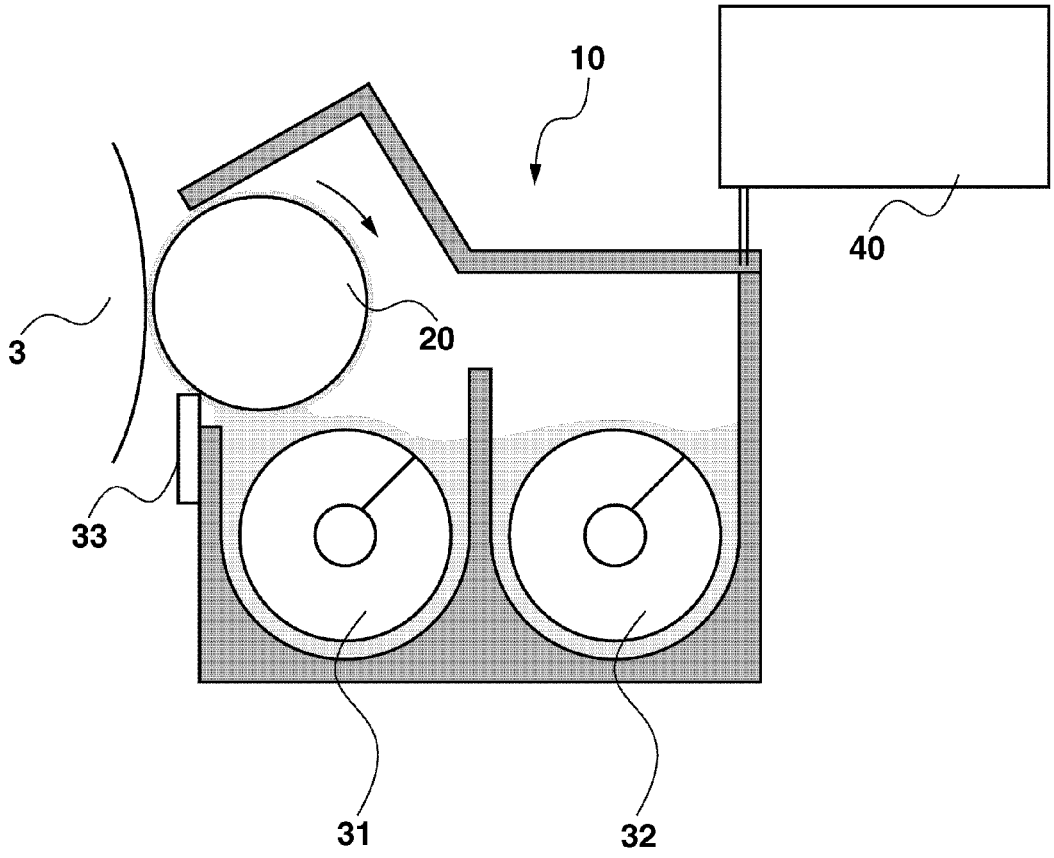
FIG. 3 is a schematic sectional view of a developing device according to each of the first to fifth exemplary embodiments of the present invention.

The developing device 10 will be described in more detail below. FIG. 3 is a schematic view of the developing device 10. As illustrated in FIG. 3, the developing device 10 includes a developer bearing member (hereinafter referred to as a developing sleeve) 20 for bearing and conveying a developer. Agitation/conveyance members 31 and 32 for agitating and conveying the developer are rotatably provided. The developing device 10 includes the developing sleeve 20, the agitation/conveyance members 31 and 32, and a developing blade 33.

A single driving unit drives the developing device 10 and the photosensitive drum 3, although not illustrated, and a mechanical clutch controls rotation driving timing. In recent years, a configuration in which a single driving unit drives a plurality of driving members has frequently been used for purposes of miniaturization and cost reduction. A replenishing operation of a replenishment device 40 for replenishing a developer is controlled so that a ratio of toners to carriers (a toner/carrier ratio) in the developing device 10 is a predetermined ratio based on a sensor (not illustrated) for sensing a toner density in the developing device 10.

Details of the operation of the developing device 10 will be described below with reference to FIGS. 3, 4, and 5.

The agitation/conveyance members 31 and 32 circulate and convey the developer in the developing device 10. The developer, which has come to the vicinity of the developing sleeve 20, adheres to the developing sleeve 20. The developing blade 33 regulates the thickness of the developer that has adhered to the developing sleeve 20. When the developing blade 33 regulates the layer thickness of the developer, pressure between the developer and another developer increases, and pressure from the developer is applied to the developing sleeve 20. The developer the layer thickness of which is regulated by the developing blade 33 is conveyed to a portion opposite to the photosensitive drum 3 and used for development. The developing sleeve 20 has a predetermined surface roughness on its surface.

Figure 4:
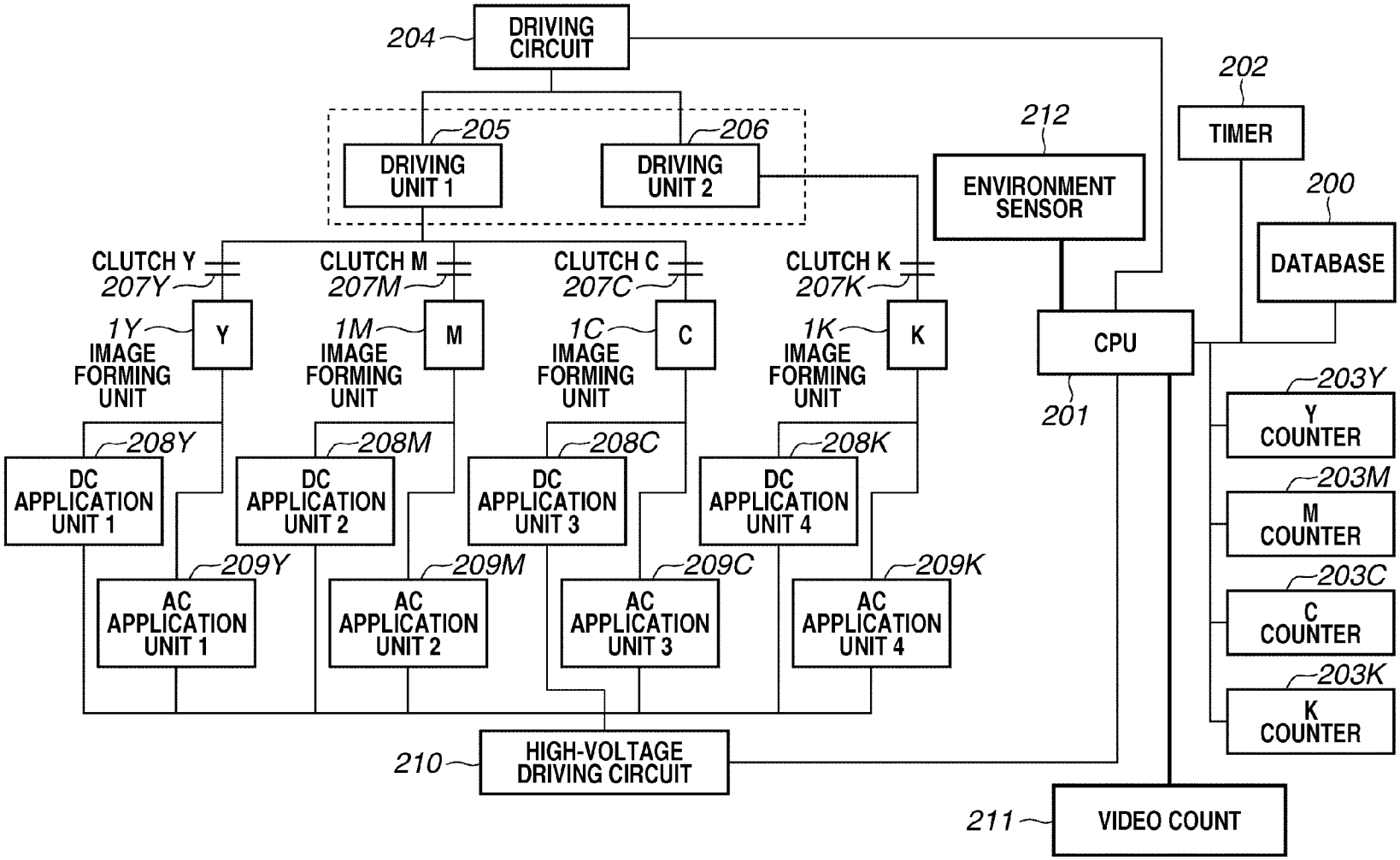
FIG. 4 is a block diagram around a developing device according to each of the first and third to fifth exemplary embodiments of the present invention.

FIG. 4 is a block diagram illustrating a configuration around the developing device 10 when the image forming units 1 operate. As illustrated in FIG. 4, driving of a first driving unit 205 is transmitted to the image forming units 1Y, 1M, and 1C, respectively, via clutches 207Y, 207M, and 207C. Driving of a second driving unit 206 is transmitted to the image forming unit 1K via a clutch 207K. The driving units 205 and 206 are connected to a driving circuit 204. Further, a CPU 201 controls timing or the like of the driving units 205 and 206 via the driving circuit 204. A configuration in which a single driving unit drives a plurality of developing devices is useful for cost reduction and miniaturization.

An AC component application unit 209 for applying an AC component as a developing bias and a DC component application unit 208 for applying a DC component as a developing bias are connected to each of the image forming units 1 so that the developing biases can be applied. The AC component application unit 209 and the DC component application unit 208 are connected to a high-voltage driving circuit 210, and are connected to the CPU 201 so that ON/OFF timing control and operation control are performed. Further, the CPU 201 includes a timer 202 for measuring and recording periods of time during which the driving circuit 204 and the high-voltage driving circuit 210 operate and their set values. The CPU 201 further includes a counter 203 for each color for counting the values measured and recorded by the timer 202. Further, the CPU 201 stores a database 200 for counting the lifetime end of the developing device 10 from the counter 203. The database 200 also stores a database for displaying and warning the lifetime end in addition to calculating the lifetime end.

Specific potentials at the photosensitive drum 3 and the developing sleeve 20 in a normal-temperature and normal-humidity environment are as follows. A surface potential at a solid white portion of the photosensitive drum 3 becomes −700 volts by the charging unit 4, and a surface potential at a solid black portion thereof becomes −250 volts by the exposure unit 5. The high-voltage application units 208 and 209 respectively apply a DC component of −520 volts and an AC component of 1700 volts as the developing biases to be applied to the developing sleeve 20. These potential conditions are taken as an example, and are changed, as needed, according to conditions such as an installation environment and a durable number of sheets of the image forming unit 1.

The image forming apparatus is configured as described above. The counter 203 counts an application time of the AC component. A value of the counter 203 is always transferred to the CPU 201 and reflected in control. Details of the control will be described below.

Figure 5:
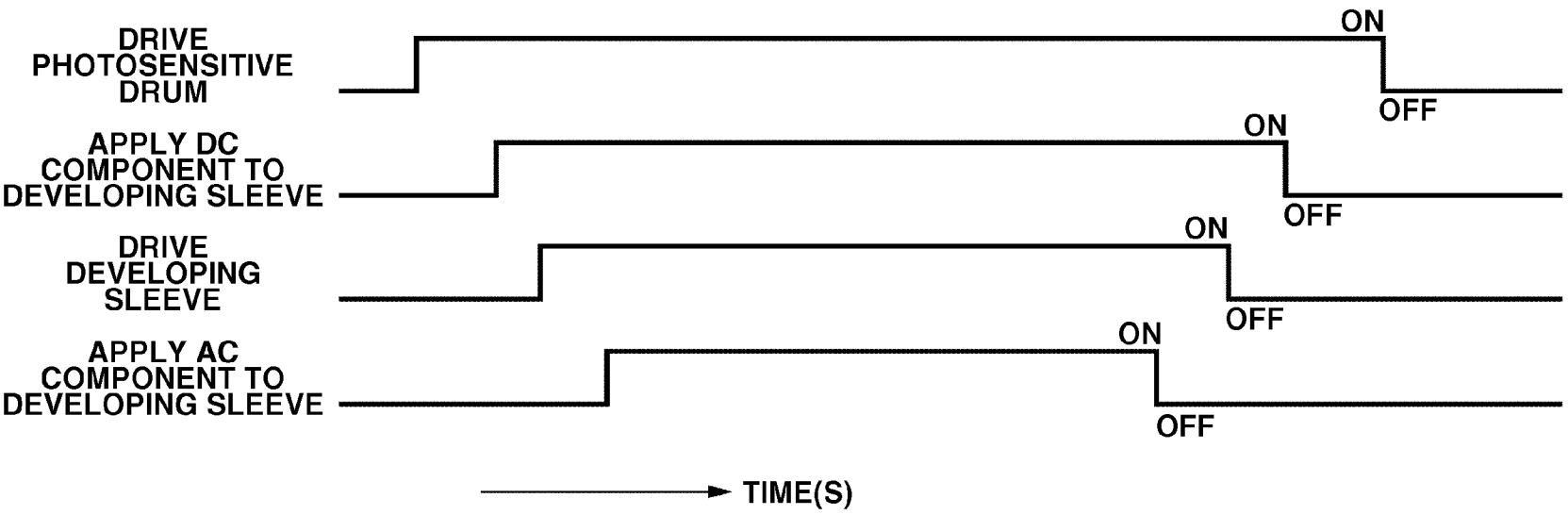
FIG. 5 is a timing chart at the time of image formation according to each of the first to fifth exemplary embodiments of the present invention.

FIG. 5 is a timing chart from the time when the developing device 10 is driven to perform development on the photosensitive drum 3 until the development is stopped. As illustrated in FIG. 5, the photosensitive drum 3 is first driven. Then, the DC component application unit 208 applies the DC component to the developing sleeve 20 so that a predetermined potential difference occurs between a potential at the developing sleeve 20 and a potential at the photosensitive drum 3 in the same timing. The clutch 207 then starts to drive the developing device 10. When the driving of the developing device 10 is started, the developing sleeve 20 and the agitation/conveyance members 31 and 32 are connected to each other by a gear or the like, and are driven in synchronization with each other. The AC component application unit 209 applies the AC component after the driving of the developing sleeve 20 is started.

However, the driving of the developing sleeve 20 deviates by several hundred microseconds from its target because the mechanical clutch turns rotation on and off. When the AC component is applied with the developing sleeve 20 stopped, the AC component is applied for a long time to only a portion opposite to the photosensitive drum 3. Local application of the AC component causes image streaks and density nonuniformity. Therefore, the AC component is required to be always applied after the driving of the developing sleeve 20 is started.

The developing device 10 may reach its lifetime end due to adhesion of the developer (hereinafter represented as fusion) to the surface of the developing sleeve 20. When the lifetime end of the developing device 10 is erroneously determined, an image having a defect such as image unevenness or fogging may be output. The developing device 10 may be replaced earlier than the lifetime end so that the running cost becomes high. If the lifetime end cannot be accurately determined, that is a grave problem.

A mechanism relating to the fusion on the surface of the developing sleeve 20 has been analyzed and examined. In the analysis and examination, a developer including toners and carriers is used. When the fusion on the surface of the developing sleeve 20 is analyzed, the toners mainly adhere to the surface of the developing sleeve 20 in a fused state. Inherently, the developer includes toners and carriers, and the toners adhere to the carriers.

However, the DC and AC biases to be applied for use in development apply a force for the toners to move toward the photosensitive drum 3 or the developing sleeve 20. In other words, they apply a force to separate the toners from the carriers because the toners and the carriers respectively have opposite charging characteristics. Particularly, the AC bias includes a bias in a development direction and a bias in a non-development direction alternately applied. The bias in the development direction causes the toners to move toward the photosensitive drum 3, and the bias in the non-development direction causes the toners to move toward the developing sleeve 20.

Ideally, the DC and AC biases can be applied so that the whole developer (toners) on the developing sleeve 20 is developed onto the photosensitive drum. However, in an actual image forming operation, an image ratio is not very high, and the toners have a particle size distribution and have different reactions to the biases. Thus, there is little possibility that the whole developer is used for development. Therefore, a part of the developer remains on the developing sleeve 20 without being used for development.

In the developer, the single toner may be separated from the carriers when the bias in the non-development direction is applied and attracted to the surface of the developing sleeve 20. The AC bias includes the biases in the development direction and the non-development direction alternately applied. Therefore, not only the toners but also the carriers move. When the bias in the non-development direction is applied, a force in a direction to move away from the developing sleeve 20 is exerted on the carriers. On the other hand, a force in a direction to be attracted to the developing sleeve 20 is exerted on the toners so that the toners and the carriers are separated from each other.

As a result, a layer including the separated toners is formed on the surface of the developing sleeve 20, and a normal layer including a mixture of the toners and the carriers is formed above the layer. Consequently, the toners existing in the upper layer are used for development, and the lower layer including only the toners is not easily used for development.

Therefore, the lower layer including only the toners do not easily separate from the surface of the developing sleeve 20. In this state, the AC bias is further applied so that the toners receive a force in a direction to be attracted to the developing sleeve 20. Further, when the developing sleeve 20 is composed of a conductor such as aluminum, the toners do not more easily separate from the surface of the developing sleeve 20 because a mirroring force is generated by a charging characteristic of the toners. When the developer includes carriers and the developing sleeve 20 includes a magnet, the carriers move according to a magnetic force. Therefore, the toners that adhere to the carriers in the upper layer move. However, the layer including only the toners does not easily move on the surface of the developing sleeve 20 because it does not react to the magnetic force. The toners stay on the surface of the developing sleeve 20 for a long period of time because they do not easily separate from the surface of the developing sleeve 20, as described above. The toners that have stayed on the surface of the developing sleeve 20 gradually enter a molten state by repeatedly receiving the AC bias and physical pressure in a developing blade portion. Particularly when an image, which does not use the toners when developed, such as a solid white image is repeatedly formed, the toners may stay on the surface of the developing sleeve 20 for a long period of time.

It was examined to what extent the presence or absence of application of the AC bias actually affected fusion on the developing sleeve 20. The examination was made by outputting the solid white image in the presence and absence of application of the AC bias to the developing sleeve 20 and confirming a surface state of the developing sleeve 20 every 1000 sheets. As the result of the examination, the fusion on the developing sleeve 20 first occurred on the 53000-th sheet under conditions of the absence of application of the AC bias (the presence of application of the DC bias). On the other hand, the fusion on the developing sleeve 20 first occurred on the 33000-th sheet under conditions of the presence of application of the AC bias. In this examination, conditions other than the presence or absence of the AC bias were satisfied to see a degree of influence of the AC bias. Accordingly, it was confirmed from the above-mentioned result that the AC bias greatly affected the fusion on the developing sleeve 20.

The result of further analysis showed that particularly the AC bias greatly contributed to the formation of the lower toner layer and the fusion on the developing sleeve 20, as described above.

Figure 6:
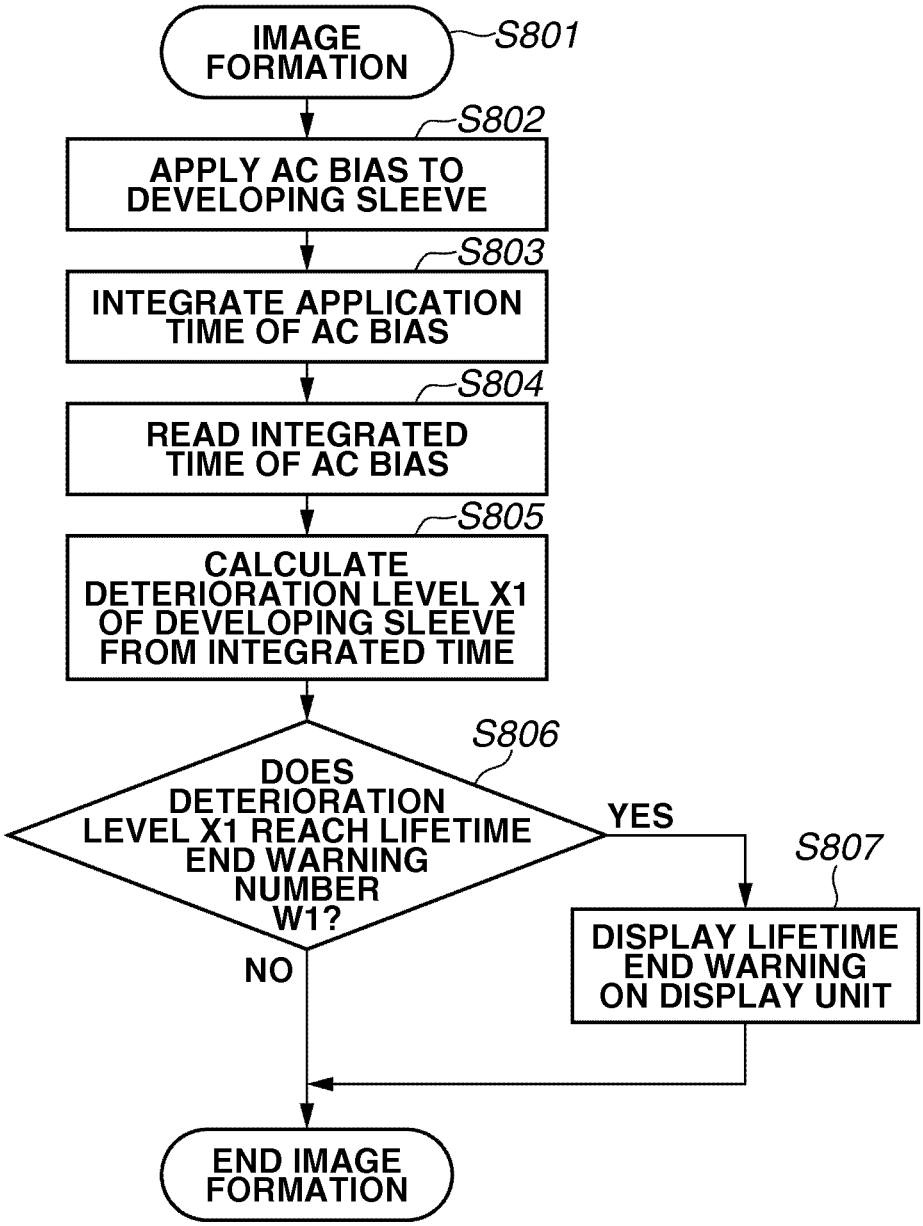
FIG. 6 is a control flowchart according to the first exemplary embodiment of the present invention.

In the present exemplary embodiment, the lifetime end of the developing device 10 is determined by integrating an application time of the AC bias to the developing sleeve 20. First, an arithmetic CPU unit serving as a control controller controls ON/OFF of the AC bias. FIG. 6 illustrates a control flowchart from the application time of the AC bias to the determination of the lifetime end of the developing device 10. A control flow for determining the lifetime end in the present exemplary embodiment will be described with reference to FIGS. 5 and 6. In step S801, the arithmetic CPU unit inputs a signal for image formation. In step S802, the arithmetic CPU applies an AC component to the developing sleeve 20 at predetermined timing for the signal for image formation. In step S803, the arithmetic CPU unit integrates an application time of an AC component simultaneously with the application of the AC component.

The arithmetic CPU unit stores a database for determining the lifetime end of the developing device 10 for the application time of the AC component. In step S804, the arithmetic CPU unit reads an integrated time of the AC component. In step S805, the arithmetic CPU unit calculates a deterioration level X1 of the developing device 10 according to the database. The database also stores a lifetime end warning number (a number of output sheets based on which a lifetime end warning is to be given) and a lifetime end reach number (a number of output sheets based on which the lifetime end is determined to be reached). In step S806, the arithmetic CPU unit determines whether the calculated deterioration level X1 (calculated value) reaches a lifetime end warning number W1 (predetermined value). If the deterioration level X1 reaches the lifetime end warning number W1 (YES in step S806), the processing proceeds to step S807. In step S807, the arithmetic CPU unit displays a lifetime end warning (a display prompting the user to replace the developing device 10) on a display unit serving as a notification unit. If the deterioration level X1 does not reach the lifetime end warning number W1 (NO in step S806), the image formation ends without display for the lifetime end. Naturally, the control flow is performed for each color so that the lifetime end is determined.

Comparative Example 1

Actually, the effect of the present exemplary embodiment was examined by being compared with that when the lifetime end was determined by integrating a driving time. The present exemplary embodiment in which the lifetime end of the developing device 10 was determined by integrating the AC component and a comparative example 1 in which the lifetime end of the developing device 10 was determined by integrating a driving time of the developing sleeve 20 were compared with each other. Respective configurations of the developing device 10 and the image forming unit 1 were similar and compared with each other by changing only control of the determination of the lifetime end. In the comparative example 1 and the present exemplary embodiment, a defective image caused by the fusion on the developing sleeve 20 was first generated on the 38000-th and the subsequent sheets.

In the comparative example 1, the lifetime end was not detected based on an integrated time of an application time of the AC bias. Therefore, the lifetime end due to the fusion was not able be detected with high accuracy. Therefore, the lifetime end due to the fusion also varied by a difference between the driving time and the application time of the AC component.

It is considered that a factor for determining a lifetime end is due to the fact that not a driving time of the developing sleeve 20 but an application time of the developing bias to the developing sleeve 20 is dominant. When the image forming unit 1 that has not been used for a long period of time performs image formation, for example, the developer decreases in a charge amount by being left as it is. Therefore, the developing sleeve 20 is idled and driven. In this case, an AC component is not applied. An idling and driving time changes depending on a status of use of the image forming apparatus. Therefore, a difference occurs between the database in the arithmetic CPU unit and the determination of the lifetime end. It may take time to rasterize image information sent from information-processing equipment into an image signal for performing image formation. In that case, while the developing sleeve 20 is driven, the AC component may not be applied thereto. Therefore, a difference occurs between the driving time and the application time of the AC component. As described above, a difference occurs between the driving time and the application time of the AC component by various factors and constraints due to the configuration control.

More specifically, a difference occurs between the application time of the AC component and the driving time, which are to be used to inherently determine the lifetime end by the fusion on the developing sleeve 20. Therefore, the determination of the lifetime end differs in the configuration according to the comparative example 1. The present invention is applicable to control of not only the configuration according to the present exemplary embodiment but also configurations each including a driving unit if a difference occurs between the application time of the AC component and the driving time. While even a warning of the lifetime end of the developing device 10 has been described in the control flow, the present invention is also applicable to display of the reach of the lifetime end and display of replacement of the image forming unit 1.

While the developing device 10 for performing development using a two-component developer including toners and carriers has been described in the present exemplary embodiment, the present invention is not limited to this. The present invention is also applicable to a developing device using a one-component developer including magnetic toners or non-magnetic toners, for example.

While the lifetime end is detected using the integrated value of only the application time of the AC bias, the lifetime end may be detected based on respective application times of an AC bias and a DC bias. In this case, the AC bias can more greatly contribute to fusion than the DC bias.

Figure 7:
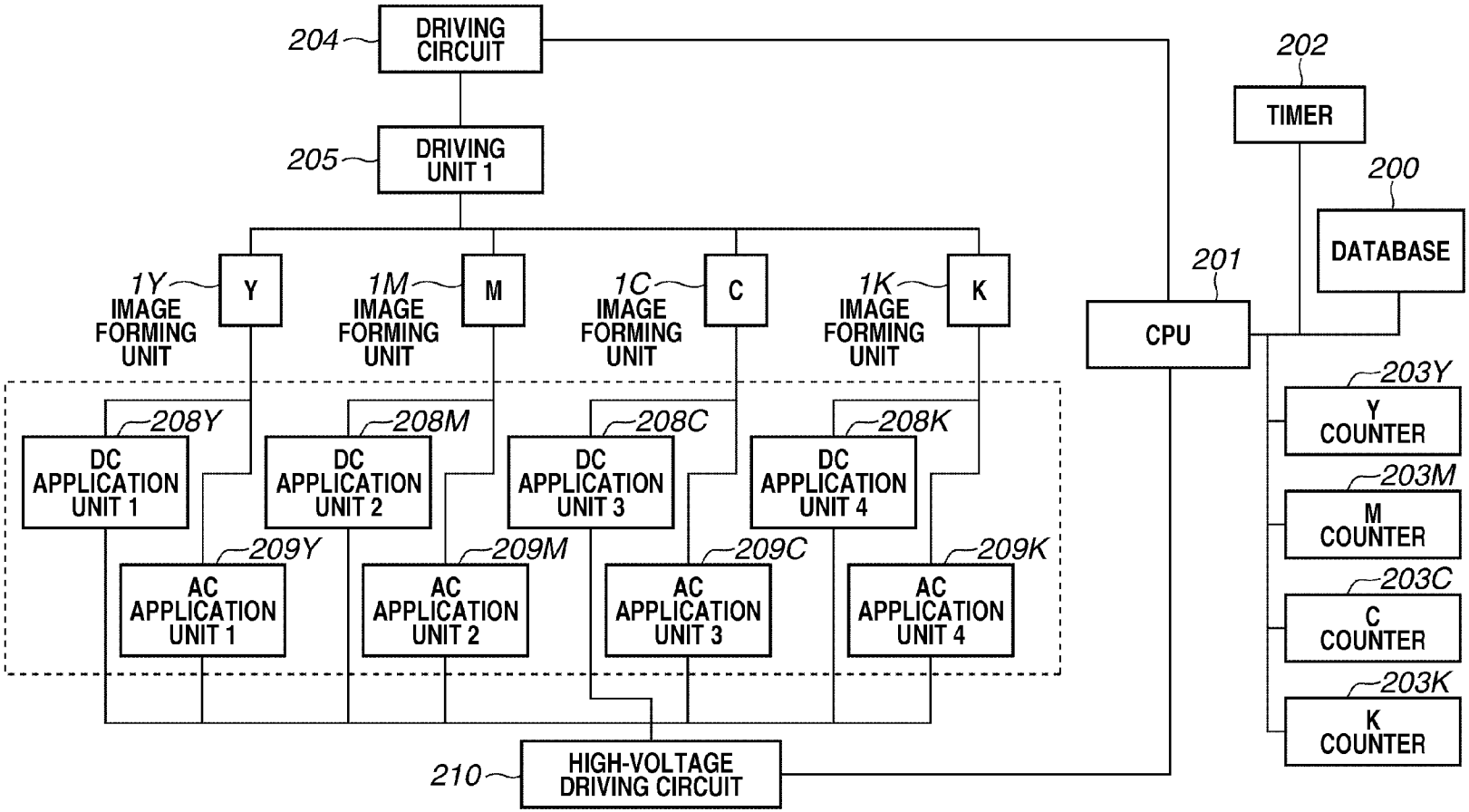
FIG. 7 is a block diagram around a developing device according to the second exemplary embodiment of the present invention.

A modified example that differs in a configuration of a driving unit from the first exemplary embodiment will be described. In the first exemplary embodiment, driving can be controlled for colors by clutches and a plurality of driving units. FIG. 7 is a block diagram illustrating a configuration around a developing device when image forming units according to a second exemplary embodiment of the present invention operate. In the second exemplary embodiment, a single driving unit 205 drives image forming units 1, as illustrated in FIG. 7. The driving unit 206 for driving the image forming unit 1K existing in the first exemplary embodiment is unified into the driving unit 205. For purposes of cost reduction and miniaturization, there is no mechanical clutch 207, and the image forming units in all colors are simultaneously turned on and off. The other configuration is similar to that in the block diagram illustrated in FIG. 4 in the first exemplary embodiment, and hence the description thereof is not repeated.

In the configuration illustrated in FIG. 7, image forming units 1 in Y, M, and C colors are driven without an AC component being applied thereto when a monochrome image is output. In this configuration, determination of a lifetime end by integrating a driving time of a developing sleeve in the conventional technique will be described. For example, the ratio of a monochrome image to a color image (a monochrome/color ratio) is 7:3.

Integrated driving times Ty, Tm, and Tc of developing sleeves in Y, M, and C colors at the time when an integrated driving time Tk of a developing sleeve in a K color reaches its lifetime end are $Tk \times 3/10$. More specifically, image forming units 1 in Y, M, and C colors respectively display lifetime end warnings at a time point that is three-tenth the actual lifetime end in the presupposed monochrome/color ratio. The lifetime end warning is displayed without reaching half of the inherent lifetime end. This is a great disadvantage for a user. If the monochrome/color ratio is 0:10, no error occurs. However, it is unlikely that the image forming units 1 are used at a monochrome/color ratio of 0:10, considering an actual user's use.

If the lifetime end of the developing device is also determined by an integrated application time of an AC component in this configuration, the above-mentioned error at the monochrome/color ratio can also be solved. A control flow in that case may be similar to that illustrated in FIG. 6 in the first exemplary embodiment. The lifetime end of the developing device is accurately determined so that a defective image can be prevented from being generated. Replacement timing is made appropriate, and an unnecessary running cost is reduced so that a main body of the image forming apparatus can be miniaturized and made low in cost.

The inventor analyzed fusion on a developing sleeve that limited a lifetime end of a developing device as an issue in the present invention. When components fused on the developing sleeve were analyzed, mainly toners in a developer were fused. Toners having a small particle diameter (small-particle-diameter toners) were fused at a high rate. In a third exemplary embodiment of the present invention, a developer including a mixture of toners and carriers was used. Toners having an average particle diameter of 5.9 μm were used. A large number of toners having a particle diameter of less than 3.5 μm, which are fused or nearly fused, were observed. A mirroring force was exerted on the toners in the vicinity of the developing sleeve, as described above. Particularly, the small-particle-diameter toners were easily triboelectrically charged so that they easily stayed on a surface of the developing sleeve because the mirroring force was great.

The inventor then examined a relationship between the small-particle-diameter toners and the fusion thereof on the developing sleeve. The examination was made by performing image formation using toners containing 20% small-particle-diameter toners and toners containing 50% small-particle-diameter toners on the same number of sheets. A fusion level of the toners containing 50% small-particle-diameter toners on the developing sleeve was two times lower than that of the toners containing 20% small-particle-diameter toners. The fusion level on the developing sleeve was determined by observing the surface of the developing sleeve using a light microscope and calculating a fusion area per predetermined area.

Further, the inventor used toners containing 50% small-particle diameter toners to perform image formation at an image ratio of 5% and at an image ratio of 50%, respectively, on the same number of sheets, to compare and examine their fusion levels. The result was that the fusion level at the image ratio of 50% was lower than that at the image ratio of 5%. More specifically, the fusion level at a high image ratio (a large amount of toner consumption) was deteriorated more greatly than that at a low image ratio (a small amount of toner consumption) even if image formation is performed on the same number of sheets (at the same driving time) and at the same application time of the AC component. In the present exemplary embodiment, the arithmetic CPU unit corrects a deterioration level (a deterioration degree of the developing sleeve) to increase as an integrated value of the amount of toner consumption increases.

The result of the foregoing shows that the fusion on the developing sleeve is also affected by a reach ratio of small-particle-diameter toners in addition to the application time of the AC component. The reach ratio of small-particle-diameter toners means an amount of small-particle-diameter toners to be supplied to the developing sleeve for a unit application time of the AC component.

The amount of the small-particle-diameter toners supplied to the sleeve can be calculated based on image information because it is proportional to the amount of toner consumption. Therefore, the lifetime end of the developing device is determined by considering not only the integrated time of the AC component but also the amount of toner consumption. More specifically, in the present exemplary embodiment, the higher the image ratio is, the larger the amount of the small-particle-diameter toners to be supplied to the developing sleeve becomes so that the shorter the lifetime end of the developing device becomes. The ratio of the small-particle-diameter toners to the toners to be replenished is taken in as data if found so that the lifetime end can be more accurately determined. In the third exemplary embodiment, a control flow will be described, considering that the ratio of the small-particle-diameter toners to the toners to be replenished is constant.

Figure 8:
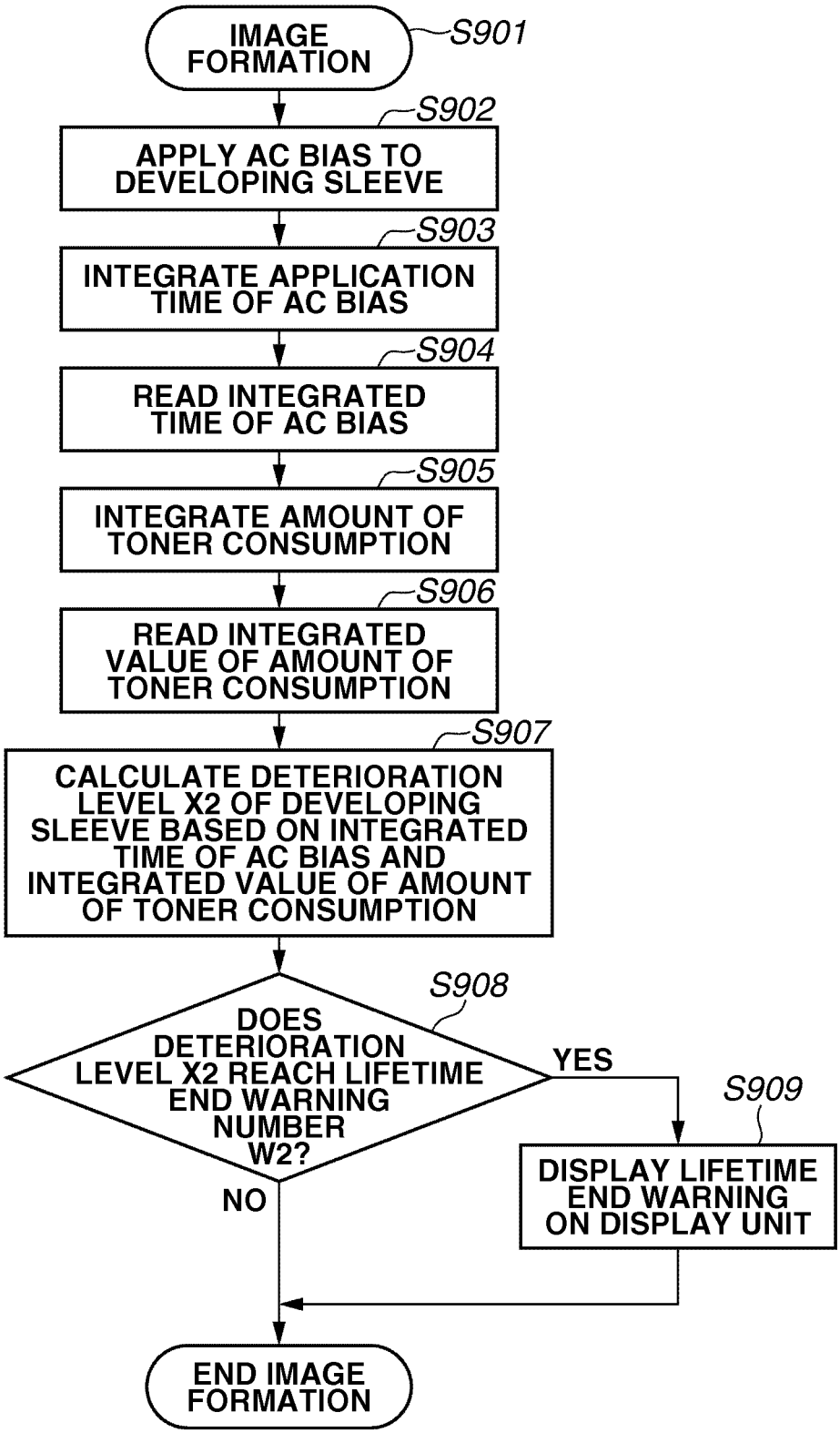
FIG. 8 is a control flowchart according to the third exemplary embodiment of the present invention.

FIG. 8 is a control flowchart according to the third exemplary embodiment. A control flow for determining a lifetime end in the present exemplary embodiment will be described with reference to FIG. 8. A configuration other than the control flow is similar to that in the first exemplary embodiment.

In step S901, an arithmetic CPU unit first inputs a signal for image formation. In step S902, the arithmetic CPU unit applies an AC component to a developing sleeve at predetermined timing for the signal for image formation. In step S903, the arithmetic CPU unit integrates an application time of the AC component simultaneously with application from the previous end of the image formation to the current end of the image formation. The arithmetic CPU unit stores a database for determining a lifetime end of a developing device for the application time of the AC component and an amount of toner consumption at the time of development.

In step S904, the arithmetic CPU unit reads a so far integrated time of the applied AC component. In step S905, the arithmetic CPU unit then calculates the amount of toner consumption per sheet based on a video count number input to the CPU 201 from the image information count 211 serving as an image information acquisition unit. In step S906, the arithmetic CPU unit reads an integrated value of the amount of toner consumption. The video count number is obtained by counting a level of an output signal of an image signal processing circuit for each pixel. Count numbers, corresponding to pixels composing a document sheet size, are integrated, to find the video count number per document sheet. For example, the document sheet size is A4, the maximum video count number per document sheet is 400 dpi, and the number of pixels is 3884×106 at 256 gradations. In step S907, the arithmetic CPU unit calculates a deterioration level X2 of the developing device according to the database.

The deterioration level X2 serving as a calculated value is specifically calculated as in the following equation. More specifically, the deterioration level X2 of the developing device 10 is calculated based on an integrated time of the AC component, which is high in a degree of influence on the lifetime end of the developing sleeve, and the integrated value of the amount of toner consumption:

$$\text{Deterioration level } X2 = (\text{application time of AC bias}) + (k0 \times \text{amount of toner consumption})$$

Here, k0 is a factor of the degree of influence on the lifetime end from the integrated value of the amount of toner consumption, and is a constant that changes depending on the image forming apparatus.

The database also stores a lifetime end warning number and a lifetime end reach number. The lifetime end warning number means a deterioration level at which it is warned that the developing device comes closer to its lifetime end (the developing sleeve is forced to be replaced) and the image formation can be continued. The lifetime end reach number means a deterioration level at which it is notified that the developing device reaches its lifetime end and the image formation is inhibited. In step S908, the arithmetic CPU unit determines whether the calculated deterioration level X2 reaches a lifetime end warning number W2. If the deterioration level X2 reaches the lifetime end warning number W2 (YES in step S908), the processing proceeds to step S909. In step S909, the arithmetic CPU unit displays a lifetime end warning on a display unit. If the deterioration level X2 does not reach the lifetime end warning number W2 (NO in step S908), the image formation ends without performing display for the lifetime end. When the actual lifetime end of the developing device and the lifetime end detected by the above-mentioned configuration control are compared with each other in the present exemplary embodiment, an error therebetween can be suppressed to approximately 3%.

The lifetime end of the developing device can be more accurately determined by considering not only the application time of the AC component to the developing sleeve but also the amount of toner consumption in the above-mentioned manner.

While the respective ratios of the small-particle-diameter toners to the toners used in the developing devices are treated as the same one, the ratios of the small-particle-diameter toners may be considered when different from each other. More specifically, a value of k0 may be set to increase as the ratio of the small-particle-diameter toners increases.

The inventor further examined a lifetime end of a developing device (fusion on a developing sleeve) as an issue in the present invention. As described above, a fusion level of the developing sleeve differs depending on whether an AC component is applied. If no AC component is applied, the fusion progresses more slowly than that when an AC component is applied. When the developing sleeve is driven for a long period of time with no AC component applied, the fusion gradually occurs. More specifically, the driving itself of the developing sleeve also contributes to the fusion on the developing sleeve, although its contribution rate differs from that of an application time of the AC component. In a fourth exemplary embodiment of the present invention, a deterioration level is changed based on a driving time of the developing sleeve. More specifically, the longer the driving time of the developing sleeve becomes, the higher the deterioration level becomes. The inventors expected that a temperature and a humidity at which the developing sleeve was operating also contributed to the fusion on the developing sleeve because toners were in a molten state. An image formation environment under a high temperature and high humidity (30° C., 70%) and an image formation environment under a normal temperature and normal humidity (23° C., 45%) were compared with each other and examined by repeatedly performing image formation under the same condition. The result was that the fusion level on the developing sleeve under the high temperature and high humidity was lower than that under the normal temperature and normal humidity. In further examination, the temperature of the developing device increased as an image forming operation was performed. The fusion on the developing sleeve deteriorated due to the temperature and humidity of the developing device. In the fourth exemplary embodiment, an arithmetic CPU unit corrects a deterioration level to increase as an average temperature during the image formation increases.

From the foregoing, the lifetime end of the developing device is required to be determined from an environment in which the developing device is installed, the application time of the AC component of the developing sleeve, the driving time, and the amount of toner consumption. In the present exemplary embodiment, a database of an operation environment, an application time of an AC component of a developing sleeve, a driving time, and an amount of toner consumption for a lifetime end of a developing device was prepared, and was stored in a database of the arithmetic CPU unit.

Figure 9:
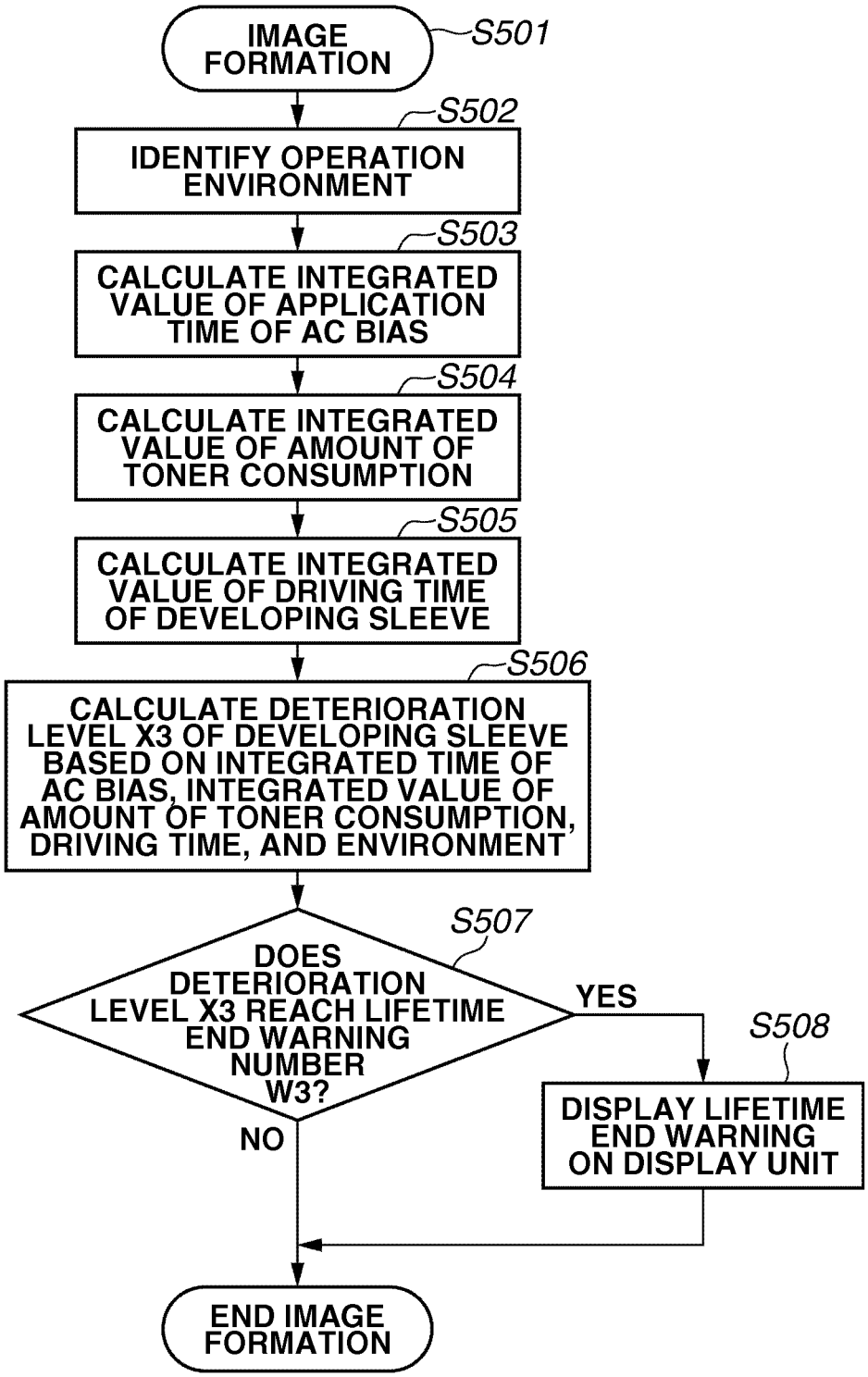
FIG. 9 is a control flowchart according to the fourth exemplary embodiment of the present invention.

FIG. 9 is a control flowchart according to the fourth exemplary embodiment. A control flow for determining a lifetime end in the present exemplary embodiment will be described with reference to FIG. 9. While a configuration other than the control flow is similar to that in the first exemplary embodiment, an environment sensor 212 serving as an environment detection unit (temperature detection unit) for identifying an operation environment can detect environmental information (temperature information around the developing device) in the present exemplary embodiment.

In step S501, an arithmetic CPU unit first inputs a signal for image formation. In step S502, the arithmetic CPU unit then identifies the operation environment. In step S503, the arithmetic CPU unit applies an AC component to a developing sleeve at predetermined timing for the signal for image formation, and calculates an integrated value of an application time of the AC component. The arithmetic CPU unit calculates an application time of the AC component applied from the previous end of the image formation to the current end of the image formation based on an input from the timer 202. The arithmetic CPU unit then calculates an amount of toner consumption based on an image signal input from the video count 211 serving as an image information input unit. In step S504, the arithmetic CPU unit calculates an integrated value of an amount of toner consumption in the current image formation. In step S505, the CPU 201 further calculates an integrated value of a driving time of the developing sleeve using the timer 202 serving as a driving detection unit.

The arithmetic CPU unit stores a database for determining a lifetime end of a developing device for the application time of the AC component, the amount of toner consumption, the driving time of the developing sleeve, and the environment (temperature). In step S506, the arithmetic CPU unit calculates a deterioration level X3 of the developing device according to the database from measured or calculated values in processes from step S502 to step S505. The deterioration level X3 is calculated by the following arithmetic equation including a plurality of terms such as the application time of the AC component, the amount of toner consumption, the driving time of the developing sleeve, and the environment:

Deterioration level $X3=(k1\times$application time of AC bias$)+(k2\times$amount of toner consumption$)+(k3\times$driving time of developing sleeve$)+(k4\times$environmental information$)+$deterioration level $X3'$ in previous calculation (k1 to k4 are factors relating to a degree of influence on a deterioration level and constants determined depending on the image forming apparatus, and are stored in the database).

The higher a detection result (an average temperature) of the environment sensor 212 is, the higher the deterioration level becomes. Therefore, the deterioration level is higher when an environment at the time of driving the developing sleeve is a high temperature than that when it is a low temperature. While only temperature information is used in the present exemplary embodiment, humidity information or both the temperature information and the humidity information may be used.

A degree of influence of each of factors such as an AC bias and an amount of toner consumption on a lifetime end is examined, to generate databases k1 to k4. A deterioration level is calculated in each image formation. Particularly, the deterioration level is calculated in consideration of influence of an amount of toner consumption and an environment on a deterioration level, which changes in time series, by adding a deterioration level calculated in the previous image formation.

The arithmetic equation is an example, and is not limited to a system for adding factors. In addition thereto, terms such as an application time of a DC bias may be added.

The database also stores a lifetime end warning number and a lifetime end reach number. In step S507, the arithmetic CPU unit determines whether a calculated deterioration level X3 reaches a lifetime end warning number W3. If the deterioration level X3 reaches the lifetime end warning number W3 (YES in step S507), the processing proceeds to step S508. In step S508, the arithmetic CPU unit displays a lifetime end warning on a display unit. If the deterioration level X3 does not reach the lifetime end warning number W3 (NO in step S507), the image formation ends without performing display for the lifetime end.

When the actual lifetime end of the developing device and the lifetime end detected by the above-mentioned configuration control are compared with each other in the present exemplary embodiment, an error therebetween can be suppressed to approximately 2%. In the above-mentioned manner, the lifetime end of the developing device 10 can be more accurately determined.

The developing device may reach its lifetime end by not only the fusion on the developing sleeve but also surface abrasion of the developing sleeve and deterioration of the developer. Accordingly, the database stored in the arithmetic CPU unit stores not only data relating to the fusion but also a database relating to the surface abrasion of the developing sleeve and the deterioration of the developer. The lifetime end of the developing device is calculated from values found in steps S503 to S505. If any one of the values reaches the lifetime end, the developing device reaches its lifetime end.

The image forming unit may have a configuration of a process cartridge obtained by integrating a developing device, a charging unit including a photosensitive drum, and a cleaning unit. The configuration of the process cartridge has an advantage in that the image forming unit can be simply replaced by a user when it reaches its lifetime end or has any defect. Therefore, the process cartridge configuration is a technique that is high in usability and is frequently used in a general-purpose image forming apparatus.

The process cartridge configuration is replaced when not only the developing device but also any one of the photosensitive drum, the charging unit, and the cleaning unit reaches its lifetime end. Accordingly, the arithmetic CPU unit is required to integrate and control not only the lifetime end of the developing device but also all the lifetime ends of the photosensitive drum, the charging unit, and the cleaning unit. When a lifetime end warning and a replacement display are issued at a time point where any one of them is determined to reach its lifetime end by the control, a defective image can be prevented from being generated. Naturally, the present invention is also applicable to the process cartridge configuration.

As a fifth exemplary embodiment of the present invention, the lifetime end of a developing device is determined by the above-mentioned control, and generation of a defective image is extended based on a determination result. More specifically, an amount of toner replenishment and high-voltage setting for performing image formation are changed based on a determination result of a lifetime end, to extend generation of a defective image.

When fusion on a developing sleeve deteriorates, there occur defects such as fogging, thin image density, image unevenness, and toner scattering. The toner scattering and the fogging are phenomena occurring because a charge amount of a developer is low. The developer is charged by friction with another developer and friction with a surface of the developing sleeve. The surface of the developing sleeve is covered with toners when fused. Therefore, friction charging with the surface of the developing sleeve is not performed. If the fusion on the developing sleeve occurs, a charge amount of the developer decreases so that defects such as toner scattering and fogging easily occur. As defects, a conveyance characteristic to and from the surface of the developing sleeve may be deteriorated, and an amount of the developer on the developing sleeve may change from a predetermined amount, to cause a density variation.

In the present exemplary embodiment, toners are developed to an exposure potential, and a potential difference between a charging potential (a potential at a non-image portion) of the photosensitive drum and a DC component applied to the developing sleeve is controlled in a predetermined range. The potential difference is hereinafter referred to as a fogging-removal potential. In the present exemplary embodiment, a CPU unit serving as a potential control unit controls the fogging-removal potential. More specifically, the fogging-removal potential is controlled to be 150 volts at the beginning of use of the developing device. When the developing device comes closer to its lifetime end so that fogging deteriorates, generation of a fogged image can be prevented by increasing the fogging-removal potential.

The fusion on the developing sleeve does not occur more easily when a weight ratio of toners to carriers (hereinafter referred to as a TC ratio) is low than when it is high.

As the TC ratio decreases, a rate at which small-particle-diameter toners reach the developing sleeve decreases. An amount of toners that can be held for one of the carriers is determined. The lower the TC ratio is, the higher the probability that the carriers hold the toners becomes before the toners adhere to the surface of the developing sleeve. Therefore, the carriers hold the toners before the toners adhere to the surface of the developing sleeve, to prevent the fusion on the developing sleeve. If the fusion on the developing sleeve starts to deteriorate, a CPU unit serving as a replenishment control unit controls toner replenishment so that the TC ratio in the developing device decreases.

Thus, the progress of the fusion on the developing sleeve can be slowed. A unit such as a magnetic permeability sensor or an optical sensor for detecting the TC ratio enables more accurate control.

The fogging-removal potential and the toner replenishment, described above, are controlled in the middle for some reasons. First, the fogging-removal potential will be described. A latent image potential formed by an exposure unit and a charging unit formed on a photosensitive drum can be smaller. When the latent image potential is formed using the exposure unit and the charging unit up to the vicinity of a limit of the capacitance of the photosensitive drum, the potential becomes unstable without being stabilized. A voltage applied to the charging unit also increases, to cause the photosensitive drum to be damaged. In a state where the developing device comes closer to its lifetime end, the charge amount decreases due to deterioration of the developer, for example, so that a potential difference required for development decreases. Even if the fogging-removal potential is increased, the latent image potential is not increased. Therefore, the fogging-removal potential may be increased in the middle.

The toner replenishment will be described below. First, the charge amount of the developer can be constant. When the charge amount changes, a development characteristic changes, so that a tint of an output image changes. The charge amount is determined by friction charging between the toners and the carriers, for example. When the developer deteriorates, the charge amount decreases. In order to keep the charge amount constant and increase the number of times of friction charging between the toners and the carriers, the TC ratio is decreased.

The charge amount is also affected by friction charging with the surface of the developing sleeve. Therefore, the TC ratio is decreased, to prevent the fusion on the developing sleeve, and to maintain friction charging with a normal surface of the developing sleeve. When the TC ratio is decreased from the beginning, the charge amount cannot be kept constant when the developer deteriorates, and thus is controlled in the middle. Specific control in the present exemplary embodiment will be described below.

Figure 10:
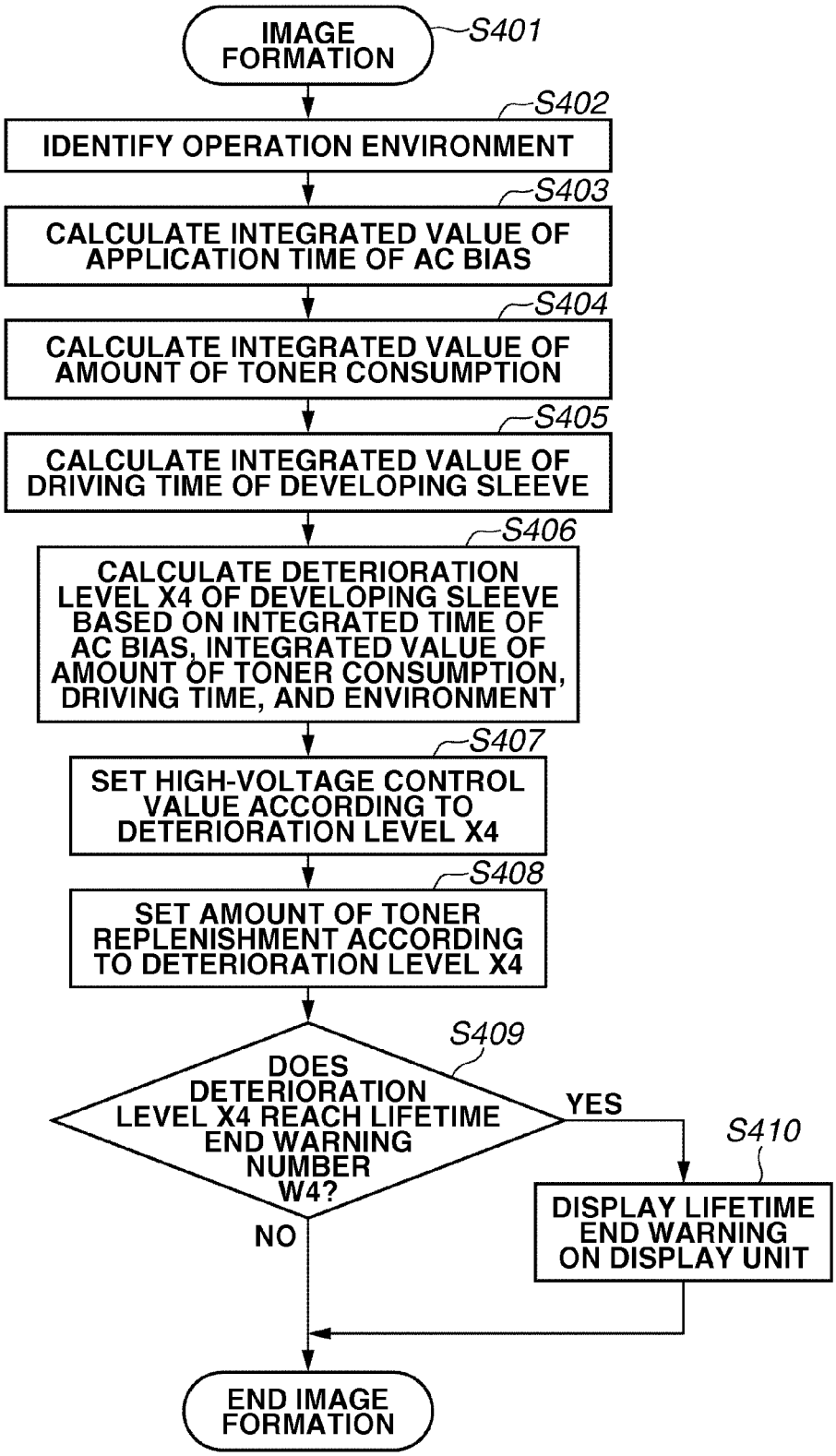
FIG. 10 is a control flowchart according to the fifth exemplary embodiment of the present invention.

FIG. 10 is a control flowchart in the fifth exemplary embodiment. A control flow for determining a lifetime end in the present exemplary embodiment will be described with reference to FIG. 10. While a configuration other than the control flow is similar to that in the first exemplary embodiment, an environment sensor for identifying an operation environment (not illustrated) is also mounted in the present exemplary embodiment.

In step S401, an arithmetic CPU unit first inputs a signal for image formation. In step S402, the arithmetic CPU unit then identifies the operation environment. In step S403, the arithmetic CPU unit applies an AC component to a developing sleeve at predetermined timing for the signal for image formation, and calculates an integrated value of an application time of the AC component. In step S404, the arithmetic CPU unit calculates an amount of toner consumption based on an input image signal, and calculates an integrated value of the amount of toner consumption. In step S405, the arithmetic CPU unit further calculates an integrated value of a driving time of the developing sleeve.

The arithmetic CPU unit stores a database for determining a lifetime end of a developing device for the application time of the AC component, the amount of toner consumption, the driving time of the developing sleeve, and the environment. In step S406, the arithmetic CPU unit calculates a deterioration level X4 of the developing device according to the database from measured or calculated values in processes from step S402 to step S405.

In step S407, the arithmetic CPU unit performs high-voltage control in the image formation, as described below, according to the calculated deterioration level X4 of the developing device. In the present exemplary embodiment, the above-mentioned fogging-removal potential is set to increase as the deterioration level X4 of the developing device increases. In the present exemplary embodiment, the fogging-removal potential can be set to a maximum of 180 volts, although it is usually 150 volts.

Thus, fogging can be prevented even if the charge amount of the developer decreases due to the fusion on the developing sleeve and the deterioration of the developer. In step S408, the arithmetic CPU unit then sets an amount of toner replenishment at the time of the image formation, as described below, according to the calculated deterioration level X4 of the developing device. At a normal time, the toners are replenished so that the TC ratio becomes 10%. The arithmetic CPU unit controls the TC ratio to decrease to 9%, 8%, and 7% as the deterioration level X4 of the developing device increases.

Conventionally, the TC ratio has been controlled by aiming at making the charge amount constant, as described above, to make the image density constant. Even if the image density is constant, however, the fusion on the developing sleeve may occur. That would be pointless if an image having a defect such as toner scattering or fogging by the fusion on the developing sleeve is generated.

According to the present exemplary embodiment, the TC ratio is controlled to decrease based on the deterioration level X4 of the developing device, to prevent the fusion on the developing sleeve. Thus, the image having a defect such as fogging or toner scattering can be prevented from being generated. Further, when the TC ratio is changed, the charge amount of the developer changes so that the image density may change. Control for making the image density constant, for example, adjusting a potential difference for performing development, is performed according to the change in the TC ratio. This enables the image density to be made constant while preventing the fusion on the developing sleeve.

In the processes in steps S407 and S408, the image having a defect occurring when the developing device reaches its lifetime end can be prevented from being generated while the progress of the fusion on the developing sleeve is slowed. In the high-voltage control, control for making high-voltage setting preferentially using small-particle-diameter toners is effective to prevent the fusion on the developing sleeve.

In step S409, the arithmetic CPU unit then determines whether the calculated deterioration level X4 reaches a lifetime end warning number W4. A database for determining the lifetime end stores a database also considering functions in steps S407 and S408. If the deterioration level X4 reaches the lifetime end warning number W4 (YES in step S409), the processing proceeds to step S410. In step S410, the arithmetic CPU unit displays a lifetime end warning on a display unit. If the deterioration level X4 does not reach the lifetime end warning number W4 (NO in step S409), the image formation ends without performing display for the lifetime end.

When the actual lifetime end of the developing device and the lifetime end detected by the above-mentioned configuration control were compared with each other in the present exemplary embodiment, an error therebetween was able to be suppressed to approximately 3%. By introducing the above-mentioned control, the lifetime end of the developing device was able to be increased to 1.2 times. The running cost can be reduced and the productivity and the usability can be improved by extending the lifetime end of the developing device and accurately determining the lifetime end of the developing device, as described above.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-095273 filed Apr. 16, 2010, which is hereby incorporated by reference herein in its entirety.

What is claimed is:

1. An image forming apparatus comprising:

a developing device including a developer bearing member for bearing and conveying a developer and configured to develop a latent image formed on an image bearing member using the developer;

a bias application unit configured to apply at least an AC bias to the developer bearing member;

an integration unit configured to integrate an application time of the AC bias applied by the bias application unit; and a determination unit configured to determine a replacement timing of the developing device based on an integrated value by the integration unit.

2. The image forming apparatus according to claim 1, wherein the determination unit determines the replacement timing of the developing device so that as the integrated value increases, the replacement timing becomes earlier.

3. The image forming apparatus according to claim 1, further comprising an image information acquisition unit configured to acquire information relating to an integrated value of an amount of the developer consumed during development, wherein the determination unit determines the replacement timing of the developing device so that as the integrated value of the amount of the developer consumed during development increases, the replacement timing becomes earlier.

4. The image forming apparatus according to claim 1, further comprising a driving detection unit configured to detect information relating to an integrated value of a driving time of the developer bearing member, wherein the determination unit determines the replacement timing of the developing device so that as the integrated value of the driving time of the developer bearing member increases, the replacement timing becomes earlier.

5. The image forming apparatus according to claim 1, further comprising a temperature detection unit configured to detect a temperature around the developing device, wherein the determination unit determines the replacement timing of the developing device so that the replacement timing becomes earlier as a detection result by the temperature detection unit during driving of the developer bearing member indicates a higher temperature.

6. The image forming apparatus according to claim 1, wherein the bias application unit applies the AC bias and a DC bias to the developer bearing member, wherein the determination unit determines the replacement timing of the developing device so that as a sum of integrated values of weighted application times of the AC bias and the DC bias increases, the replacement timing becomes earlier, and wherein the application time of the AC bias is more greatly weighted than that of the DC bias.

* * * * *